United States Patent [19]

Urfer

[11] Patent Number: 4,732,696

[45] Date of Patent: Mar. 22, 1988

[54] MONOGLYCOSIDES AS VISCOSITY MODIFIERS IN DETERGENTS

[75] Inventor: Allen D. Urfer, Decatur, Ill.

[73] Assignee: A. E. Staley Manufacturing Company, Decatur, Ill.

[21] Appl. No.: 54,127

[22] Filed: May 22, 1987

Related U.S. Application Data

[63] Continuation of Ser. No. 796,674, Nov. 8, 1985, abandoned, which is a continuation of Ser. No. 668,762, Nov. 6, 1984, abandoned.

[51] Int. Cl.[4] ..... C11D 3/06

[52] U.S. Cl. ..... 252/174.17; 252/132; 252/135; 252/546; 252/550; 252/554; 252/558; 252/DIG. 14

[58] Field of Search ..... 252/132, 135, 174.17, 252/546, 550, 551, 554, 555, 558, DIG. 14

[56] References Cited

U.S. PATENT DOCUMENTS

| | | | |
|---|---|---|---|
| 3,219,656 | 11/1965 | Boettner | 252/174.17 |
| 3,598,865 | 8/1971 | Lew | 252/174.17 |
| 3,721,633 | 3/1973 | Ranauto | 252/527 |
| 4,396,520 | 8/1983 | Payne et al. | 252/174.17 |
| 4,483,779 | 11/1984 | Llenado et al. | 252/174.17 |
| 4,483,780 | 11/1984 | Llenado | 252/174.17 |
| 4,483,787 | 11/1984 | Jones et al. | 252/174.17 |
| 4,488,981 | 12/1984 | Urfer et al. | 252/174.17 |

FOREIGN PATENT DOCUMENTS

| | | |
|---|---|---|
| 0077167 | 4/1983 | European Pat. Off. . |
| 0105556 | 4/1984 | European Pat. Off. . |

*Primary Examiner*—Paul Lieberman
*Assistant Examiner*—Willie Thompson
*Attorney, Agent, or Firm*—Michael F. Campbell; James B. Guffey; J. Daniel Wood

[57] ABSTRACT

Monoglycosides have been found to increase the viscosity of aqueous-based detergent compositions containing anionic surfactants.

17 Claims, No Drawings

MONOGLYCOSIDES AS VISCOSITY MODIFIERS IN DETERGENTS

This application is a continuation of application Ser. No. 796,674 which was filed on Nov. 8, 1985, now abandoned, and which is, in turn, a continuation of application Ser. No. 668,762 which was filed on Nov. 6, 1984, now abandoned.

BACKGROUND OF THE INVENTION

1. Field of the Invention

This invention deals with liquid detergent products.

2. Description of the Art Practices

In recent years, it has become common for detergent manufacturers to move away from powdered or granular detergent products to liquids. The liquid detergents usually contain a substantial amount of water in the product. Liquid detergent products are considerably easier to manufacture than are granular detergent products. The latter materials require a substantial amount of capital investment for spray-drying towers. Additionally, a consumer preference has emerged for the liquid products due to their more concentrated form. Most liquid detergent products do not contain the inert inorganic material which is required to give spray-dried granules their crisp, non-caking structure. Accordingly, the liquid detergent products are used in much smaller amounts while giving approximately the same level of active ingredients in the wash water.

A second consumer preference is for a product having a desirable viscosity. Products which are water-thin are not desirable. In part, products which are too thin are more likely to be spilled by the consumer when attempting to handle the approximately four-litre bottles in which liquid detergents are commonly packaged. Another advantage of liquid detergent products is that they can be applied directly to a heavily soiled portion of a garment. In such cases, raising the viscosity of a normally thin liquid detergent product allows the detergent to stay on the soiled area longer. A market also exists for shampoo, liquid hand soaps, body soaps, dishwashing liquids, cosmetics and personal care products having a relatively high viscosity.

Various methods of thickening liquid detergent products are known in the art. These methods employ cellulosic polymers such as carboxymethylcellulose, guar gums, xanthan, colloidal silicates or clays. The glucoside ester-ether adducts as described in U.S. Pat. No. 4,450,090 to Kinney issued May 22, 1984 are suggested as thickeners for olefin sulfonates.

The use of short chain alkyl polyglycosides to reduce viscosity in aqueous liquid detergent compositions is taught in Urfer et al Ser. No. 529,435, filed Sept. 6, 1983. Pat. No. 4,488,981 issued Dec. 18, 1984. The particular glycosides taught by Urfer are those materials containing from 2 to 6 carbon atoms in the alkyl portion and from 1 to 10 saccharide units. U.S. Pat. No. 3,219,656 issued Nov. 23, 1965 to Boettner teaches the production of alkyl polyglycosides including those glycosides prepared from an oxo-undecyl alcohol, and as compounds, the 2,6,8-trimethyl-4-nonanol glycosides.

Renauto in U.S. Pat. No. 3,721,633 issued Mar. 20, 1973 teaches aqueous built liquid detergent compositions disclosing alkyl polyglycosides and anionic surfactants in combination with inorganic detergent builders. U.S. Pat. No. 4,077,894 issued Mar. 7, 1978 to Langdon et al describes glycol-based anti-freeze products containing a glycoside for the purpose of foam suppression.

Payne et al in U.S. Pat. No. 4,396,520 issued Aug. 2, 1983 describe the combination of alkyl polyglycosides and calcium-sensitive anionic surfactants in granular detergent compositions. U.S. Pat. No. 4,446,042 issued May 1, 1984 to Leslie describes the preparation of detergent products containing nonionic surfactants, cationic surfactants, anionic brighteners and glycosides in heavy-duty liquid detergent compositions.

Rau in U.S. Pat. No. 4,465,828 issued Aug. 14, 1984 described alkyl saccharides (glycosides) which are stated to have improved color due to the inclusion of a hydroxypolycarboxylic acid. Rau also discloses that the glycosides may be formed from a saccharide and a fatty alcohol containing from 1 to 20 carbon atoms which may be primary or secondary or having a straight or branched chain.

European Published Patent application No. 0070075 laid open on Jan. 19, 1983 to Cook et al describes alkyl polyglycoside detergent compositions which contain as an anionic cosurfactant an alkylk benzene sulfonate, an alkyl glycerol either sulfonate, an alpha-olefin sulfonate, an alkyl polyethoxy carboxylate or mixtures of the foregoing. Arnaduis in European Patent application Publication No. 0077167 published on Apr. 20, 1983 describes a process of manufacturing surface-active glycosides in the presence of reducing acids. The Arnaduis application states that the glycosides may contain branching in the hydrophobic portion and that the alcohol may be primary or secondary.

Mao in European Published Application No. 0092875 published on Nov. 2, 1983 discloses a process for the production of alkyl glycosides involving a wipe-film evaporator. Mao further teaches that the fatty portion of the glycoside may be a primary or secondary alcohol having straight or branched chains which may be either saturated or unsaturated and may contain ether linkages as well. Substantially similar teachings to European published application No. 0092875 are also found in U.S. Pat. No. 4,393,203 issued July 12, 1983 to the same inventor.

European Published Application No. 0096917 (laid open Dec. 12, 1983) to Farris describes the production of glycosides containing from 8 to 25 carbon atoms in the alcohol residue of the glycoside. The alcohol residue may be primary or secondary, straight or branched and obtained from a saturated or unsaturated material. European Patent Publications No. 0 105 556 to Jones et al made public Apr. 18, 1984 describes detergent products containing glycosides, nonionics, and anionics. Canadian Pat. No. 919,424 to Culver et al issued Jan. 23, 1973 describes alkaline drain cleaning compositions containing phosphate esters, and a glycoside or an anionic surfactant.

To the extent that the references mentioned herein are applicable to the present invention, they are incorporated by reference. Throughout the specification and claims, percentages and ratios are by weight, temperatures in degrees Celsius, and pressures in atmospheres over ambient unless otherwise indicated.

SUMMARY OF THE INVENTION

This invention describes a liquid detergent comprising: (a) from about 3% to about 45% by weight of an anionic surfactant; (b) from about 0.3 to about 20% by weight of monoglycoside containing 8 to 30 carbons in the hydrophobic moiety; and (c) from about 30% to about 95% by weight of water. Also described is a method of increasing the viscosity of an aqueous liquid detergent composition containing an anionic surfactant by including therein an effective amount of an alkyl monoglycoside to thicken the aqueous liquid detergent composition.

DETAILED DESCRIPTION OF THE INVENTION

The glycosides which have been found useful in increasing the viscosity of aqueous detergent products containing an anionic surfactant are monoglycosides.

The term monoglycoside as used herein includes such substituted monosaccharides as fructosides, glucosides, mannosides, galactosides, talosides, allosides, altrosides, idosides, arabinosides, xylosides, lyxosides, ribosides, and mixtures thereof.

Conveniently, the monoglycosides useful in raising the viscosity of the detergent composition are represented as

ROG wherein R is the hydrophobic moiety (fatty organic portion) of the molecule, O is an oxygen, preferably in the 1 position of the saccharide, and G represents the saccharide. While more than one R group may be on each saccharide molecule (attached as an ether linkage), the difficulty and expense outweigh the benefit of introducing more than the initial hydrophobic moiety.

It is observed that the benefits of the invention in the order of importance are that the glycoside first be a monoglycoside, and second that the glycoside contain from about 8 to about 30, preferably 10 to 24, and most preferably 12 to 18 carbon atoms in the hydrophobic moiety of the molecule. Preferably a third condition is that the hydrophobic moiety on the monoglycoside be branched either by using a secondary alcohol or by branching within the hydrophobic moiety. A further variable herein is that the branching is desirably multiple branched, e.g., several groups. The oxo alcohols having multiple methyl branching are particularly desirable.

The following is a brief description of the manner of obtaining the monoglycoside utilized herein. The monoglycoside is preferably a glucoside and may be obtained as is described in U.S. Pat. No. 3,219,656 to Boettner issued Nov. 23, 1965 or the article entitled "Preparation and Properties of Pure Alkyl Glucosides, Maltosides, and Maltotriosides", by Koeltzow and Urfer, JAOCS, V. 61, No. 10, p. 1651 (1984), which are herein incorporated by reference. The amount of monoglycoside obtained can be maximized by utilizing an excess of alcohol to promote the acetal formation over the polymerization reaction.

Particular alcohols which may be utilized herein are n-dodecyl, n-tridecyl, n-tetradecyl, n-pentadecyl, n-hexadecyl, n-octadecyl, n-decyl, tetramethyl 1-nonanol, and trimethyl-nonanol. Secondary alcohols which may be used to obtain the monoglycoside include 2-decanol, 2-undecanol, 2-dodecanol and 2-tridecanol.

Additional alcohols which may be employed in forming the monoglycoside include guerbet alcohols such as are described in U.S. Pat. No. 4,425,458 to Lindner issued Jan. 10, 1984.

The anionic surfactants which are useful herein are alkyl ether sulfates, alkyl benzene sulfonates, alkyl sulfates, olefin sulfonates, paraffin sulfonates and soap (carboxylate). Particularly valuable are those anionic surfactants containing from 10 to 20 carbon atoms in the hydrophobic portion of the molecule. A preferred surfactant group is the alpha-olefin sulfonates. A second preferred surfactant is an alkyl ether sulfate which contains an average of from 1 to 3 ethoxy groups in the molecule. The preferred cation for the anionic surfactants is sodium or potassium or mixtures thereof. Further anionic surfactants which may be employed are those described in U.S. Pat. No. 4,476,045 to O'Lenick issued Oct. 9, 1984.

Alkoxylated nonionic surfactants are to be minimized as an ingredient in the compositions of this invention. It has been found that nonionics such as ethoxylated alcohols reduce the viscosity thereby negating the advantages of the monoglycosides described herein. Typically the alkoxylated nonionic should not be present at greater than about 10%, preferably less than about 5% by weight. It has also been observed that higher glycosides ($DP_2$ and greater) reduce the viscosity as the DP increases and the hydrophobic moiety decreases. Therefore higher ($DP_2$ and greater) glycosides are preferably minimized such that the average DP is less than 1.4, preferably less than 1.3.

The amount of glycoside as monoglycoside in the product is preferably from about 0.5% to about 10%, most preferably from about 1% to about 5% by weight. The amount of anionic surfactant in the formula is preferably from about 5% to about 30%, most preferably from about 8% to about 25% by weight. The level of water in the product is conveniently set at from about 35% to about 92%, preferably from about 40% to about 90% by weight. It is also desirable that the amount of monoglycoside as used herein be in a weight ratio to the anionic surfactant of from about 4:1 to about 1:60, preferably from about 2:1 to about 1:10.

The Ingredients of the present invention may be combined in any convenient manner. A preferred order of addition of the components involves obtaining the monoglycoside in its solid state, and adding thereto a mixture of the anionic surfactant and water. As the anionic surfactant is usually a fairly concentrated material, it is often necessary to add further water to the end mixture to obtain the desired product. As the viscosity will increase substantially as the monoglycoside is added, adequate mixing and pumping capabilities should be utilized to ensure that the product may be efficiently transferred.

Desirably the product herein will have a viscosity of from about 50 to about 100,000, preferably from about 150 to about 10,000 cps at 25° C. as determined by a Brookfield cone-plate viscometer having a cone angle of 1.57°.

The compositions of the present invention may also include all manner of materials normally found in aqueous liquid detergent products including, compatible hydrotropes, optical brighteners and dyes, perfumes, enzymes and the like. Additional ingredients which may be included in the composition of the present invention include builders such as tripolyphosphate, nitrilotriacetate, pyrophosphate and any of the organic builders as discussed in Valenty. U.S. patent application No. 575,421 filed Jan. 31, 1984 (now U.S. Pat. No. 4,524,009; issued June 1, 1985).

The products of the invention when utilized as laundry detergent products are normally employed at from about 0.05% to about 1% by weight of the active ingredients in the wash water. It is recommended that the laundry be washed at from about 37° C. to 60° C.

The products herein may also be formulated as liquid dishwashing or hard surface cleaning products in a similar fashion. As dishwashing products are typically of a lower viscosity than is desired for a laundry detergent product, smaller quantities of the monoglycoside may be used. The products described herein are also useful in cosmetics, handcleaners, body soaps, shower gels, shaving creams or gels and hair shampoos. The pH of the products described in the Summary should be from about 5 to about 8 when diluted on a dry solids basis at 0.1% by weight when no other pH influencing ingredients are present. The products are conveniently adjusted to a pH of from about 2.5 to 7.8, preferably 3 to 7.5, most preferably 3 to 7.2 to give maximum thickening. Any convenient buffer or pH adjusting material such as citric acid and its salts may be employed herein.

The following are suggested exemplifications of the present invention.

EXAMPLE I

Several glycosides are prepared. These glycosides are obtained from substantially pure compounds according to Koeltzow and Urfer, supra. These compounds are referenced in the style of $R_xDP_y$ wherein R indicates the starting alcohol used to prepare the glycoside, x indicates the chain length of the alcohol, and DP indicates that the material is a saccharide having a degree of polymerization as indicated by y, e.g., $DP_1$ is glucose.

The following glucosides are obtained:

| | | | |
|---|---|---|---|
| (a) | $C_{10}DP_1$ | (e) | $C_{15}DP_1$ |
| (b) | $C_{12}DP_1$ | (f) | $C_{10}DP_2$ |
| (c) | $C_{13}DP_1$ | (g) | $C_{12}DP_2$ |
| (d) | $C_{13}DP_1$* | (h) | $C_{12}DP_3$ |

*Obtained as a branched chain alcohol described as an isomeric mixture of branched primary aliphatic alcohols containing carbon numbers predominantely in the range of $C_{11}$ through $C_{14}$ with $C_{13}$ as the main constituent. The $C_{12}$ content is approximately 20%. It boils in the approximate range of 250° C. to 265° C. (482° F. to 509° F.). The alcohol is typically quite low in $C_{11}$ content (less than 2%); $C_{14}$ content is estimated at 4%.

EXAMPLE II

A base formulation of an anionic surfactant is prepared containing:

| | |
|---|---|
| Sodium alpha-olefin sulfonate | 8% dsb |
| Sodium lauroyl sarconsinate | 3% dsb |
| Ammonium chloride | 2% dsb |
| Additive - see below | 3% dsb |
| Water q.s. to 100% | |

The pH of the base formula is adjusted and maintained from 5 to 5.5 with citric acid.

A series of comparative examples as described below are made by including the additive from Example 1 into the base formula. The results are shown in Table 1.

TABLE I

| Additive | Viscosity cps |
|---|---|
| None | 4 |
| 3% Cocoamide monoethanolamine | 1903 |
| 3% APG $C_{10}DP_1$ | 162 |
| 3% APG $C_{12}DP_1$ | 703 |
| 3% APG $C_{13}DP_1$ | 926 |
| 3% APG $C_{13}DP_1$* | 1655 |
| 3% APG $C_{15}DP_1$ | 724 |
| 3% APG $C_{10}DP_2$ | 4 |

TABLE I-continued

| Additive | Viscosity cps |
|---|---|
| 3% APG $C_{12}DP_2$ | 8 |
| 3% APG $C_{12}DP_3$ | 4 |

*See Note Example 1

The above test uses as a standard cocoamide monoethanolamine which is a commonly accepted viscosity control agent for liquid detergent products. Like all amines the cocoamide monoethanolamine has a slightly objectionable odor. The products of this invention are free of objectionable odors.

EXAMPLE III

A base formula is prepared as indicated in Example II with the exception that the additive is increased to 4% and the water in the formulation is decreased in a corresponding amount. The oxo alcohol product* gives a viscosity measurement of 3049. A control sample utilizes an equal amount of Glucamate DOE-120 which is a methyl glucoside dioleate with 120 moles ethylene oxide. The control gives a viscosity of 835.

* See Note Example I

EXAMPLE IV

Substantially similar results are obtained in Example II when a similar amount of a $C_{14}$ triethoxysulfate sodium salt is employed. Further, substitution for the olefin sulfonate with a $C_{12}$ linear alkyl benzene sulfonate potassium salt gives substantially similar results.

I claim:

1. A liquid detergent composition comprising:

(a) from about 5% to about 30% by weight of an anionic surfactant;

(b) from about 1% to about 5% by weight of a monoglycoside containing 8 to 30 carbons in the hydrophobic moiety;

(c) about 2% by weight of ammonium chloride; and (d) from about 30% to about 95% by weight of water, and wherein (e) the content, if any, of glycoside compounds having a degree of polymerization, D.P. of 2 or more within said composition is such that the average D.P. of all glycoside compounds within said composition is less than 1.4 and (ii) the pH of said composition is from 5 to 5.5.

2. The composition of claim 1 wherein the anionic surfactant is selected from the group consisting of alkyl sulfates, olefin sulfonates, paraffin sulfonates, alkyl benzyl sulfonates, alkyl ether sulfates, alkyl carboxylates, and mixtures thereof.

3. The composition of claim 1 wherein the monoglycoside is a monoglucoside.

4. The composition of claim 1 wherein the anionic surfactant is a mixture of sodium alpha-olefin sulfonate and sodium lauroyl sarcosinate.

5. The composition of claim 1 wherein the anionic surfactant is present at from about 8% to about 25% by weight.

6. The composition of claim 1 further containing a detergent builder.

7. The composition of claim 6 wherein the detergent builder is a nitrilotriacetate or phosphate salt.

8. The composition of claim 1 wherein the hydrophobic moiety is derived from a secondary alcohol.

9. The composition of claim 1 wherein the hydrophobic moiety is derived from a branched alcohol.

10. The composition of claim 1 wherein the hydrophobic moiety contains about 10 to about 24 carbon atoms.

11. The composition of claim 1 additionally containing up to about 10% by weight of an alkoxylated nonionic surfactant.

12. The composition of claim 11 wherein the nonionic surfactant is an ethoxylated alcohol.

13. The composition of claim 1 wherein the hydrophobic moiety is derived from an oxo-alcohol structure.

14. The composition of claim 1 wherein the surfactant ingredients therein consist essentially of anionic surfactants and glycoside compounds.

15. The composition of claim 1 wherein the the glycoside ingredient consists essentially of monoglycoside materials.

16. The composition of claim 1 wherein said composition has a viscosity of from about 50 to about 100,000 cps.

17. The composition of claim 1 wherein said composition has a viscosity of from about 150 to about 10,000 cps.

* * * * *